US008813367B1

(12) United States Patent
Linn

(10) Patent No.: US 8,813,367 B1
(45) Date of Patent: Aug. 26, 2014

(54) BOLSTER LOCK TOOL

(75) Inventor: Eric P. Linn, Post Falls, ID (US)

(73) Assignee: Buck Knives, Inc., Post Falls, ID (US)

( * ) Notice: Subject to any disclaimer, the term of this patent is extended or adjusted under 35 U.S.C. 154(b) by 884 days.

(21) Appl. No.: 12/789,376

(22) Filed: May 27, 2010

Related U.S. Application Data

(60) Provisional application No. 61/182,066, filed on May 28, 2009.

(51) Int. Cl.
*B26B 1/04* (2006.01)

(52) U.S. Cl.
USPC ..... 30/161; 30/153

(58) Field of Classification Search
USPC ..... 30/2, 160, 161, 335, 125, 153, 155, 30/157, 133
See application file for complete search history.

(56) References Cited

U.S. PATENT DOCUMENTS

| | | | | | |
|---|---|---|---|---|---|
| 552,928 | A | | 1/1896 | Russell | |
| 1,701,027 | A | | 6/1927 | Brown | |
| 4,173,068 | A | * | 11/1979 | Cargill | 30/161 |
| 4,985,998 | A | | 1/1991 | Howard | |
| 5,111,581 | A | * | 5/1992 | Collins | 30/161 |
| 5,461,786 | A | | 10/1995 | Miller | |
| 5,755,035 | A | * | 5/1998 | Weatherly | 30/161 |
| 6,732,436 | B2 | * | 5/2004 | Moizis | 30/155 |
| 7,000,323 | B1 | | 2/2006 | Hatcher et al. | |
| 7,284,329 | B1 | * | 10/2007 | King | 30/161 |
| 7,302,760 | B2 | * | 12/2007 | Lake | 30/161 |
| 7,313,866 | B2 | | 1/2008 | Linn et al. | |
| 7,581,321 | B2 | * | 9/2009 | Kain | 30/153 |
| 7,676,932 | B2 | * | 3/2010 | Grice et al. | 30/160 |
| 7,979,990 | B2 | * | 7/2011 | Hawk et al. | 30/155 |
| 2004/0244205 | A1 | * | 12/2004 | Linn et al. | 30/159 |
| 2007/0169354 | A1 | * | 7/2007 | Ralph | 30/160 |
| 2008/0201953 | A1 | * | 8/2008 | Bremer et al. | 30/1 |
| 2008/0222896 | A1 | * | 9/2008 | Marfione et al. | 30/157 |
| 2011/0203115 | A1 | * | 8/2011 | Onion | 30/159 |

OTHER PUBLICATIONS

Knovel Illustrated Sourcebook of Mechanical components, edited by Parmley, R.O. © 2000 McGraw-Hill. p. 9-4.*

* cited by examiner

*Primary Examiner* — Boyer D Ashley
*Assistant Examiner* — Fernando Ayala
(74) *Attorney, Agent, or Firm* — Kilpatrick Townsend & Stockton LLP

(57) ABSTRACT

A folding tool includes a bolster that acts as a safety and lock release. The tool may be designed for one-hand opening. An implement is held in a stored closed position by a safety formed by the bolster and a button style lock. The implement can be opened to the ready-for-use position by rotating the bolster to release the safety, and then rotating the implement. Once the implement is open, the bolster is rotated back to its original position setting the lock for the tool.

13 Claims, 11 Drawing Sheets

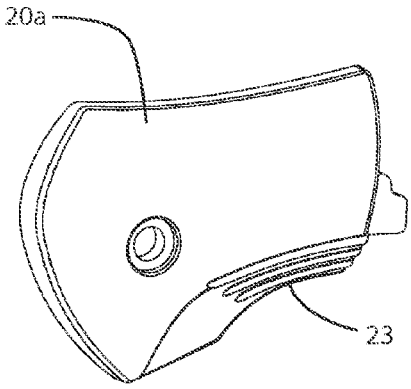
FIG. 4A
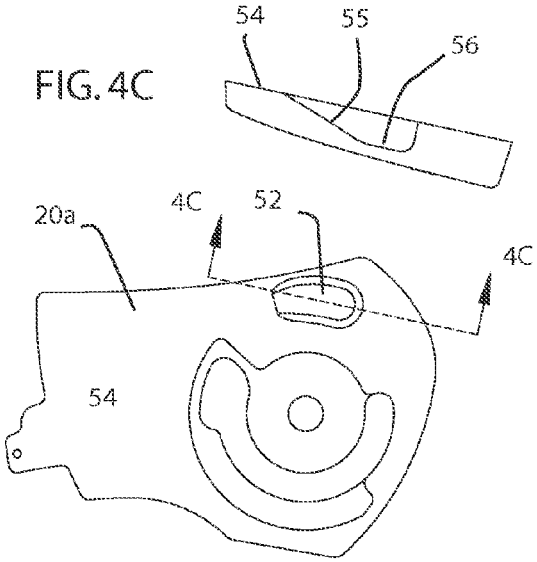
FIG. 4C
FIG. 4B
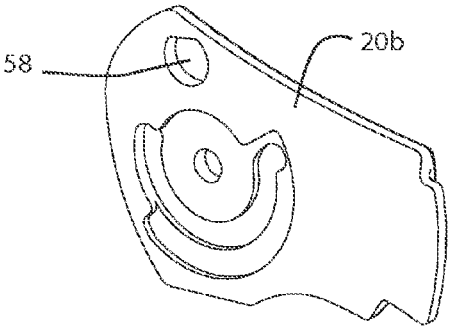
FIG. 5

76
38
72
18
40
9C
14
46
78
42
17
44
10C
12C
48

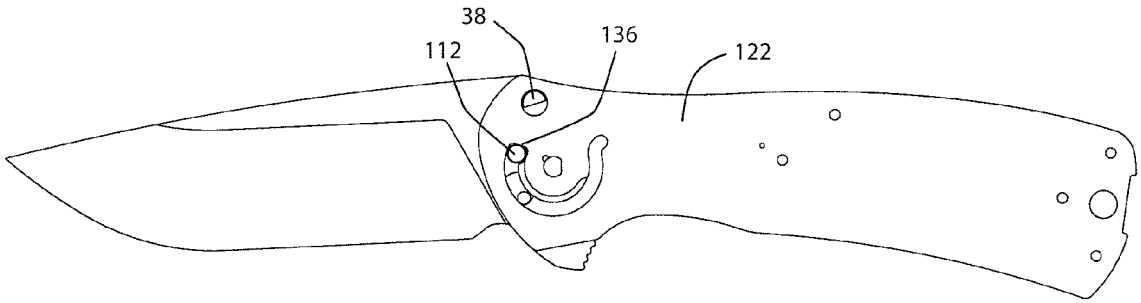
FIG. 17
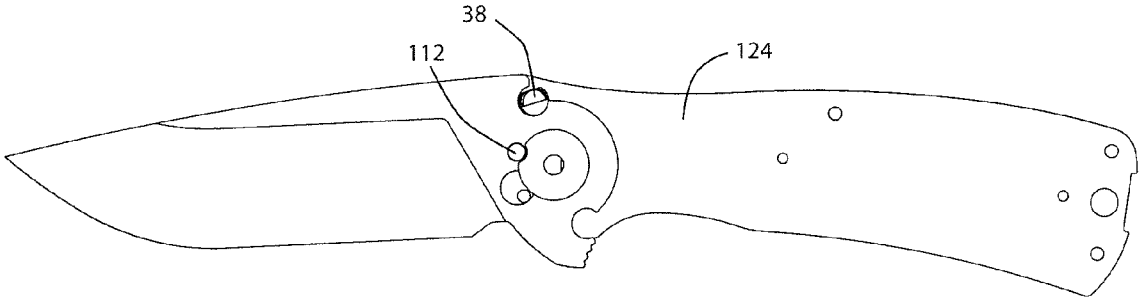
FIG. 18
FIG. 19
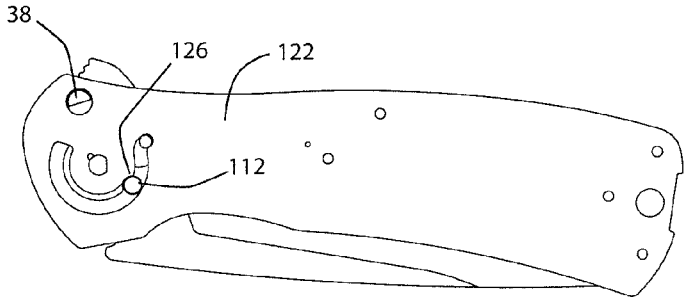
FIG. 20
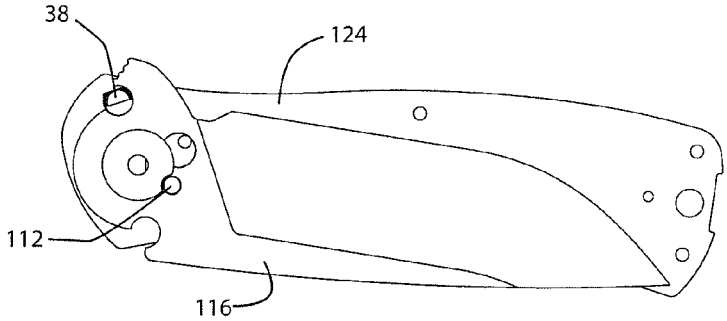

BOLSTER LOCK TOOL

CROSS-REFERENCE TO RELATED APPLICATIONS

This application claims the benefit of Provisional Patent Application Ser. No. 61/182,066, filed May 28, 2009, entitled "BOLSTER LOCK KNIFE," which is incorporated herein by reference for all purposes.

BACKGROUND

Pivoting tools are desirable for many uses. For example, pivoting knives may have blades that can be extended for use and retracted into a handle for storage or when not in use. Further, implements such as saw blades, hooks, gut hooks, punches, restraint cutters, etc. may be advantageously pivoted between positions such as stored and use positions. As with knife blades, these other implements may be extended for use and retracted into a handle when not in use. Also, multiple implements may be provided with a tool on a single pivoting mechanism, such as a knife blade on one end and a carabiner on another end. The mechanism can pivot between a position where the knife blade is extended for use while the carabiner is received by a handle and another position where the knife blade is received by the handle and the carabiner is extended for use (sec U.S. Pat. No. 7,000,323).

It is often desirable for tools to be locked in place when in position for use. For example, it is often desirable for knife blades or saw blades to be locked in position when extended for use to assist with use and for safety reasons. Thus, several mechanisms, exist for locking knife blades and other implements in position, e.g., liner locks, lockback mechanisms, push-button locks (see U.S. Pat. No. 7,000,323), etc.

Various forms of folding knives with a bolster-actuated lock are known. Typically they have a locking rocker modified to be activated by a rotating bolster. A user opens the blade by a thumb stud or other means of contact. Once fully open, a locking rocker arm with a latching portion engages the tang of the blade. The rocker is biased to latch into a notch of the tang on the blade, thus inhibiting the blade from closing during use. The user can close the blade into the handle by pushing on the bolster that is in contact with the rocker. As the bolster rotates, the rocker latch portion is moved out of the notch in the blade tang, allowing the blade to be closed.

SUMMARY

An example of a folding tool includes: a handle including first and second housing members configured to be grasped by a user's hand, the first and second housing members extending along a length of the tool and providing a cavity between the first and second housing members; an implement disposed between the first and second housing members and pivotally connected to the first housing member and the second housing member about a pivot pin between an open position and a closed position, the implement including a first operative portion configured to extend external to the handle when in the open position, the implement configured to be at least partially received by the cavity when the implement is in the closed position, the implement further including a tang that provides a pivot hole configured to receive the pivot pin, the tang further providing a locking receptacle; a locking member movably connected to one of the housing members to move substantially transverse to a length of the implement, the locking member being configured to be received by the locking receptacle provided by the implement and to inhibit rotation of the implement when received by the locking receptacle; and a bolster pivotally connected to the first housing member to be rotated between a locked position and an locked position, the bolster being disposed and configured to engage the locking member such that with the locking member received by the locking receptacle, when the bolster is rotated the bolster and the locking member will interact to retract the locking member from the locking receptacle to facilitate rotation of the implement.

Implementations of such a folding tool may include one or more of the following features. The locking receptacle has a circularly-shaped perimeter and the locking member has an arcuate perimeter of varying radius along a length of its axis. The locking receptacle is an open locking receptacle disposed to lock the implement in the open position when the open locking receptacle receives the locking member, and the tang provides a closed locking receptacle disposed to lock the implement in the closed position when the closed locking receptacle receives the locking member. The tang provides an arcuate surface with a constant radius from a pivot axis of the implement and extending between the open locking receptacle and the closed locking receptacle, and the open and closed locking receptacles are notches extending at least partially radially away from the arcuate surface. The arcuate surface is an outer surface of the tang and the open and closed locking receptacles extend toward the pivot axis from the arcuate surface.

Other implementations of the example folding tool may include one or more of the following features. The folding tool may include a stop post extending from the tang, and interfering means for inhibiting rotation of the implement while the locking member is being received by the locking receptacle. The interfering means includes a surface of a liner, fixedly attached to the first housing member, extending at least partially transverse to an arc traveled by the stop post when the implement is rotated.

An example of a folding knife includes a handle including first and second handle portions fixedly connected to each other and providing a blade storage area between the handle portions; a blade pivotally connected to the handle to allow rotation of the blade from an open position extending away from the handle portions to a closed position where the blade is received by the blade storage area; a bolster pivotally connected to the handle such that the bolster can rotate between a bolster lock position and a bolster unlock position; and locking means coupled to the handle, the blade, and the bolster, for locking the blade to inhibit rotation of the blade relative to the handle in response to rotation of the bolster by moving a locking mechanism substantially transverse to a length of the handle to engage the blade.

Implementations of such a folding knife may include one or more of the following features. The locking means includes portions of the blade and are configured to lock the blade in the open position and in the closed position. The blade pivots about a pivot axis and has a tang portion with an outer arcuate surface section between an open locking notch and a closed locking notch, the arcuate outer surface being concentric with the pivot axis, where a sharp closed lip is provided at a junction between the arcuate tang portion and the closed locking notch and a sharp open lip is provided at a junction between the arcuate tang portion and the open locking notch. The locking mechanism includes a locking button and a portion of the bolster disposed and configured to engage the locking button such that if the locking button is fully received by one of the locking notches, then when the bolster is rotated the bolster and the locking button will interact to move the locking button away from being fully received by the one of the locking notches, the locking button allowing rotation of the blade between the open and closed positions when all portions of the locking member overlapping with a thickness of the blade along an axis parallel to the pivot axis are disposed further from the pivot axis than the closed lip or the open lip, respectively. The locking notches have arcuate perimeters, and the locking button has a domed top surface and a frusto-conical portion having a largest radius exceeding radii of the arcuate perimeters of the locking notches.

Other implementations of the example knife may include one or more of the following features. The locking means further includes a stop pin, at least one open inhibiting surface, and at least one closed inhibiting surface, where the locking mechanism is configured to interact with the blade while being moved to engage the blade to lock the blade in the open position to cause open rotation of the blade further toward the open position and the stop pin and the at least one open inhibiting surface are disposed and configured to stop the open rotation of the blade caused by the locking mechanism, and the locking mechanism is configured to interact with the blade while being moved to engage the blade to lock the blade in the closed position to cause closing rotation of the blade further toward the closed position and the stop pin and the at least one closed inhibiting surface are disposed and configured to stop the closing rotation of the blade caused by the locking mechanism.

Another example of a folding knife includes: a handle including first and second housing members configured to be grasped by a user's hand, the first and second housing members extending along a length of the tool and providing a cavity between the first and second housing members; a cutting blade disposed between the first and second housing members and pivotally connected to the first housing member and the second housing member about a pivot pin between an open position and a closed position, the cutting blade including a first operative portion configured to extend external to the handle when in the open position, the cutting blade configured to be at least partially received by the cavity when the cutting blade is in the closed position, the cutting blade further including a tang that provides a pivot hole configured to receive the pivot pin, the tang further providing a locking surface including: an arcuate portion extending angularly about a pivot axis of the pivot pin; an open locking extension defined at least partially by an open locking surface extending sharply away from the arcuate portion, at least a portion of the open locking surface being circular, the open locking extension extending from the arcuate portion toward an interior of the tang; a closed locking extension defined at least partially by a closed locking surface extending sharply away from the arcuate portion, at least a portion of the closed locking surface being circular, the closed locking extension extending from the arcuate portion toward an interior of the tang; a bolster pivotally connected to the handle and including a ramped recess provided by an inner surface of the bolster; locking means including a locking button disposed in one of the locking extensions when the blade is locked and disposed adjacent to the arcuate portion when the blade is unlocked throughout rotation of the cutting blade between the open position and the closed position, the locking button being slidably receivable by the locking extensions and biased substantially transverse to a length of the cutting blade, the locking means for inhibiting opening rotation of the cutting blade with the locking button engaging the closed locking surface and for inhibiting closing rotation of the cutting blade with the locking post engaging the open locking surface, the locking means further for urging the cutting blade toward the open position when engaging the open locking surface and for urging the cutting blade toward the closed position when engaging the closed locking surface; and stopping means attached to the cutting blade and configured to stop closing rotation of the cutting blade with the locking post engaging the closed locking surface and urging the cutting blade toward the closed position and to interfere with the handle to stop opening rotation of the cutting blade with the locking post engaging the open locking surface and urging the cutting blade toward the open position.

Implementations of such a folding knife may include one or more of the following features. The stopping means includes a stop pin and a handle liner fixedly connected to the first housing member and providing inhibiting surfaces disposed and configured to interfere with the stop pin to stop rotation of the cutting blade.

Items and/or techniques described herein may provide one or more of the following capabilities. Knife safety can be improved, e.g., by facilitating closing of knives with one hand without placing a finger in a closing path of a cutting edge. Knife safety can be improved by facilitating one-hand opening and closing of a knife, and by locking a knife blade in both closed an open positions, even if the knife blade does not have spring-assisted opening. Knife safety can be improved by facilitating one-hand opening or closing of a knife by using an index finger on a tang portion of a knife blade. While one or more item/technique-effect pairs have been described, it may be possible for a noted effect to be achieved by means other than those noted, and a noted item/technique may not necessarily yield the noted effect.

BRIEF DESCRIPTION OF THE DRAWINGS

FIG. 4A is a left-side perspective view of an outer surface of a rotating bolster of the knife.

FIG. 4B is a plan view of an inner surface of the rotating bolster.

FIG. 5 is a perspective view of an inner surface of a fixed bolster of the knife.

FIG. 17 is a plan view of the alternative knife in an open locked position, partially disassembled but including the left-side liner.

FIG. 18 is a plan view of the alternative knife in the open locked position, partially disassembled with the left-side liner removed.

FIG. 19 is a plan view of the alternative knife in a closed locked position, partially disassembled but including the left-side liner.

FIG. 20 is a plan view of the alternative knife in the closed locked position, partially disassembled with the left-side liner removed.

DETAILED DESCRIPTION

An example of a folding knife according to the disclosure includes a bolster that acts as a safety and lock release. The knife may be designed for one-hand opening. The blade is held in a stored closed position by a safety formed by the bolster and a button style lock. The blade can be opened to the ready-for-use position by rotating the bolster to release the safety, and then rotating the blade. Once the blade is fully open, the bolster is rotated back to its original position setting the lock for the knife. This helps prevent the blade from moving from the open position to or toward the closed position. The blade can be returned to the storage position by rotating the bolster again, releasing the lock, and then rotating the blade back to the closed position and rotating the bolster back to the original, safety/locked position.

The lock and safety are one mechanism. The blade has two notches into which a button locks the blade in a fixed position. The button is biased by a spring to the lock position. The button acts as a stop for the blade and as a lock. The button has an angled surface that engages a notch of the blade and a relief to allow the blade to rotate when in an unengaged position. The rotating bolster has a ramp relief that contacts a crown of the button. With the bolster in a first position, the button is in an engaged position, engaging a lock notch in the blade. When the bolster is rotated to a second position, the ramp of the bolster contacts the button crown and moves the button to the unengaged position.

A stop pin may be used to help prevent play in the blade when locked. The stop pin engages with an end wall of a slot in a liner when the blade is open, and engages with a lip in the slot when the blade is closed. This provides a third point of contact to help secure the blade in the open and closed positions, respectively, and to reduce play or wobble in the blade when in the open and closed positions.

The disclosure relates to folding knives, and particularly to a bolster lock and safety mechanism. The bolster lock and safety mechanism may, but need not, be used in an assisted opening knife. For a discussion of an assisted opening knife, see U.S. Pat. No. 7,313,866.

Figure 1A:
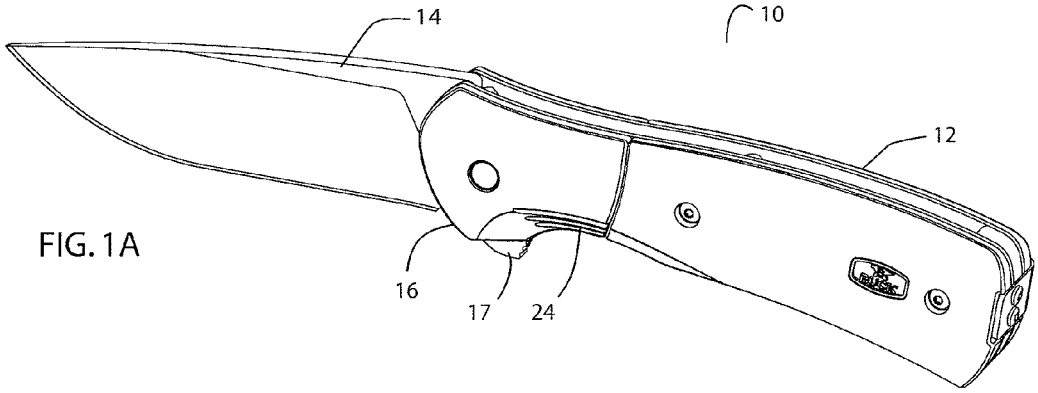
FIG. 1A is a left-side perspective view of a folding knife with a blade in an open position.
Figure 1B:
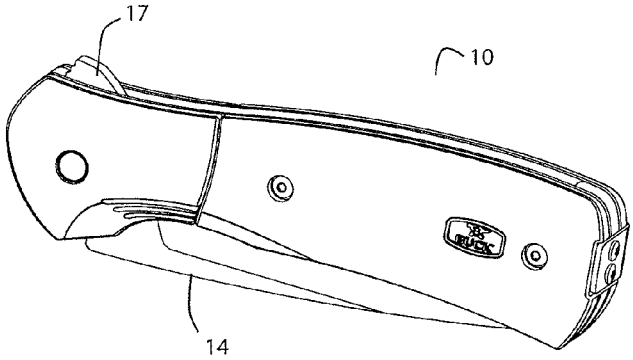
FIG. 1B is a left-side perspective view of the folding knife, shown in FIG. 1A, with the blade in a closed position.

Referring to FIGS. 1A-1B, a knife 10 includes a handle 12, and an implement 14, with the handle 12 including a bolster 16 that serves as a locking and unlocking actuator. As shown, in this preferred embodiment, the tool 10 is a folding knife, with the implement 14 being a pivoting knife blade. In alternative embodiments, the implement 14 can be a variety of other implements, such as: a carabiner; a cutting implement such as a package opener, a gut hook, a utility blade, a restraint cutter with or without a pivoting, shearing mechanism; a punch; an awl; a glass breaker; a screwdriver; a hoof pick; an opener such as a can opener, a bottle opener, or a paint can opener; or other implement. The tool 10 is configured to have the implement 14 pivot from an open position, shown in FIG. 1A, into a closed position shown in FIG. 1B where the implement 14 is received by a cavity of the handle 12. Preferably, as described more fully below, the tool 10 is configured to lock the implement 14 in both the open position and the closed position.

Figure 2:
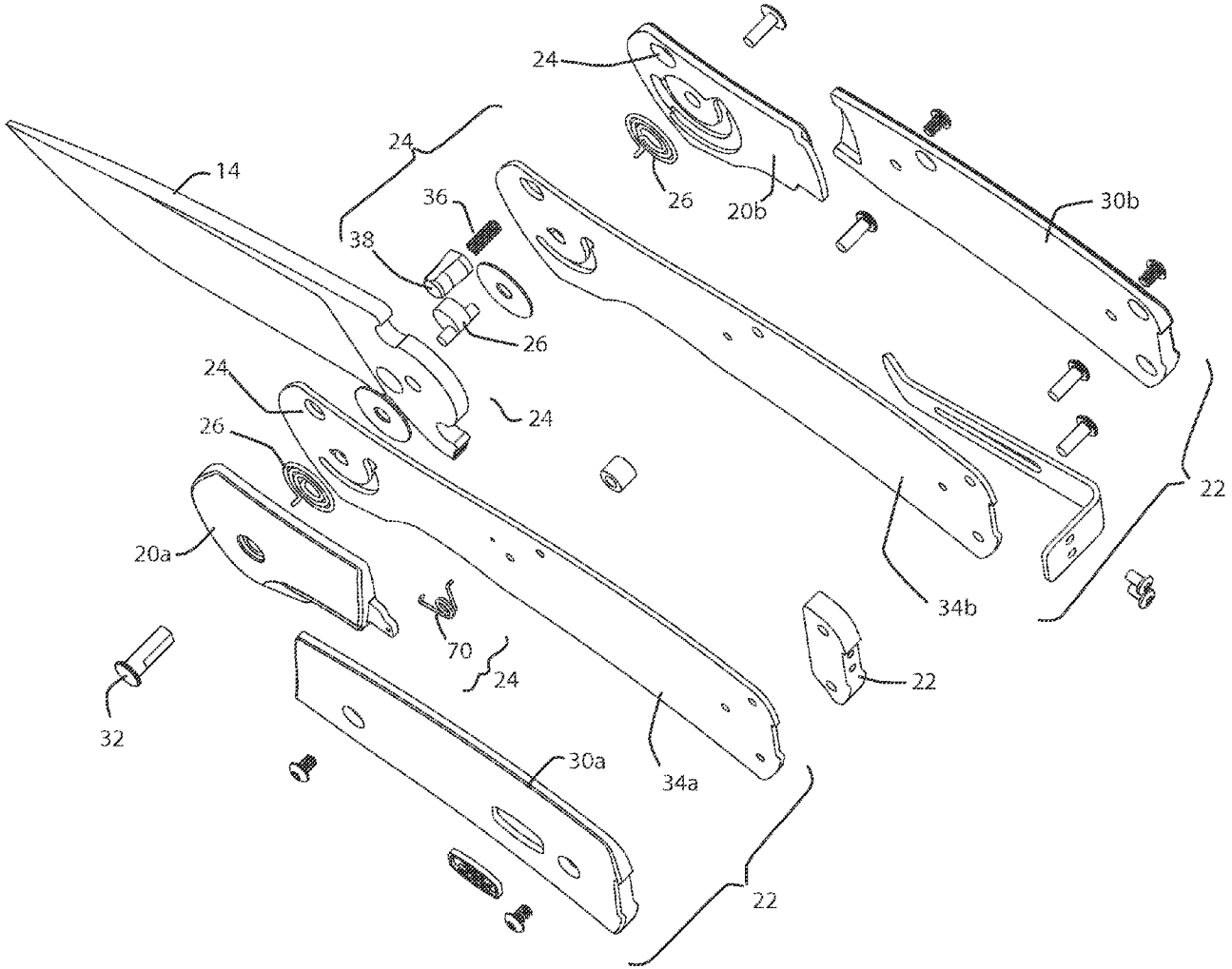
FIG. 2 is an exploded view of the knife.

Referring also to FIG. 2, the tool 10 includes the implement 14, a handle assembly 22, a locking assembly 24, and a belt clip 25. The handle assembly 22 is configured to retain the portions of the knife 14 when assembled, while allowing rotation of the blade 14 and locking of the blade 14 in both the open and closed positions as determined by the locking assembly 24. The locking assembly 24 is configured to allow the blade 14 to rotate between the open and locked positions and to restrain the blade 14 in both the locked and open positions. The belt clip 25 can be attached to the handle assembly 22, e.g., with screws. Various spacers and attaching mechanisms, e.g., screws hold the knife 10 together in a desired fashion using known techniques and are not described in detail here. Further, the tool 10 is configured as an open-assisted knife, including an assist mechanism 26. Such an assist mechanism is discussed in U.S. Pat. No. 7,313,866 and thus not described in detail here.

The handle assembly 22 includes housing members 30*a*, 30*b* and bolsters 20*a*, 20*b*. The housing members 30*a*, 30*b* help provide safe storage for the blade 14 when not in use, i.e., in the closed position. The bolsters 20*a*, 20*b* are positioned at the end of the housing members 30*a*, 30*b* where the blade 14 extends when in use. The left bolster 20*a* has thumb ridges 23 (FIG. 4A) to help provide friction for a user pushing on the bolster 20*a* to cause the bolster 20*a* to rotate. The blade 14 rotates around a pivot pin 32 from the storage area between the housing members 30*a*, 30*b* to the open, ready-for-use position. The blade 14 includes a protrusion or actuator arm (flipper) 17 on a tang 18 (FIG. 3) of the blade 14 to facilitate rotation of the blade 14 from the closed position toward the open position.

The locking assembly 24 includes portions of handle liners 34*a*, 34*b*, the tang 18 of the blade 14, a biasing spring 36, a lock button 38, and a portion of the right bolster 20*b*. The liners 34*a*, 34*b* are shaped in conjunction with the housing members 30*a*, 30*b* such that perimeters of the liners 34*a*, 34*b* closely match at least portions of boundaries of the housing members 30*a*, 30*b* and the bolsters 20*a*, 20*b* such that the liners 34*a*, 34*a*, when attached to the handle assembly 22, e.g., with rivets or screws, will be substantially fixed (i.e., not rotate) relative to the housing members 30*a*, 30*b*.

Figure 3:
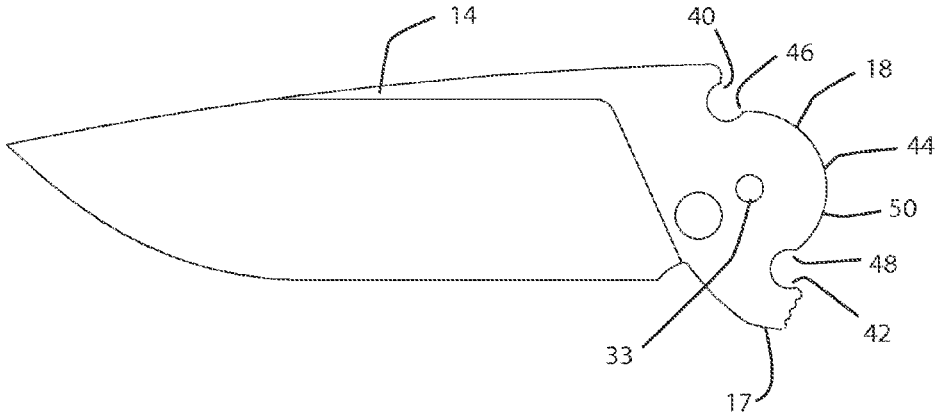
FIG. 3 is a left plan view of the knife blade.

Referring also to FIG. 3, the blade portion of the locking assembly 24 includes an open lock notch 40 and a closed lock notch 42 provided by an outer surface 44 of the tang 18. Here, and preferably, there are sharp, non-smooth transitions defining ridges 46, 48 between the notches 40, 42 and an arcuate portion 50 of the outer surface 44 of the tang 18. The transitions between notches 40, 42 and the arcuate portion 50 are configured to work in conjunction with the lock button 38

(described further below) to urge the lock button 38 into the notches 40, 42 and once seated in one of the notches 40, 42, to help retain the lock button 38 within the notch 40, 42.

Referring to FIGS. 2 and 4A-4C, the left-bolster portion of the locking assembly 24 includes a lock well 52 provided by an inner surface 54 of the bolster 20*a*. The lock well 52 provides a lock ramp 55 and a deep end 56. The lock ramp 55 is angled with respect to a length of the knife 10, i.e., a longitudinal axis of the blade 14. The lock ramp 55 is configured to slidably (along the well's length) receive a top portion of the lock button 38. The well is configured such that as the bolster 20*a* is rotated about the pivot pin 32, the lock button 38 will slide along the well's length and be pushed transverse to the length of the knife 10, against the bias force of the biasing spring 36. The deep end 56 is configured to receive enough of the top portion of the lock button 38 to allow the lock button to be received by the lock notches 40, 42 as described above, and further described below. Further, a bolster spring 70 connects the left liner 34*a* to the left bolster 20*a* and biases the left bolster 20*a* to the locked position shown in FIGS. 1A-1B.

Referring also to FIG. 5, the right-side bolster portion of the locking assembly 24 includes a relief recess 58 provided by an inner surface 60 the right bolster 20*b* and configured to slidably receive a bottom portion of the lock button 38. The recess 58 is aligned with the lock well 52 transverse to the length of the knife 10 throughout rotation of the left bolster 20*a*. The recess 58 provides a flat wall 62 configured to interact with a flat surface of the lock button 38 to inhibit rotation of the lock button 38.

Figure 6:
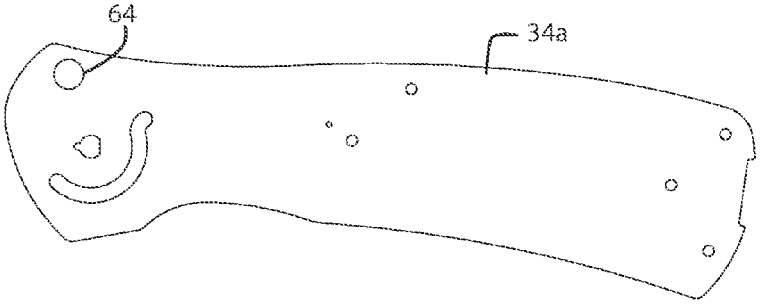
FIG. 6 is a plan view of a left-side liner of the knife.
Figure 7:
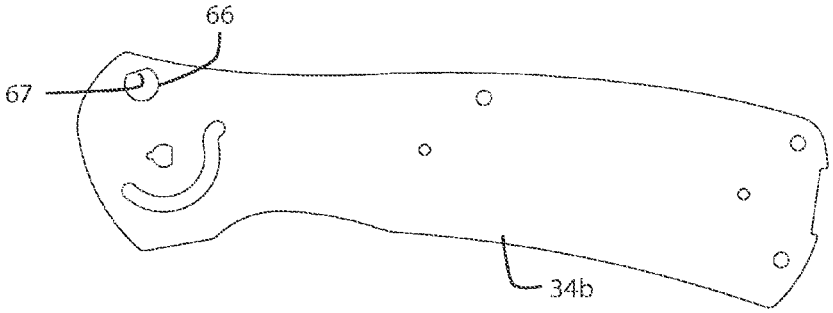
FIG. 7 is a plan view of a right-side liner of the knife.

Referring to FIGS. 2 and 6-7, the liner portions of the locking assembly 24 includes lock button holes 64, 66 provided by the liners 34*a*, 34*b*, respectively. The holes 64, 66 are aligned and configured to slidably receive the lock button 38. The hole 64 is round while the hole 66 provides a flat wall 67 configured to interact with a flat surface of the lock button 38 to inhibit rotation of the lock button 38.

Figure 8C:
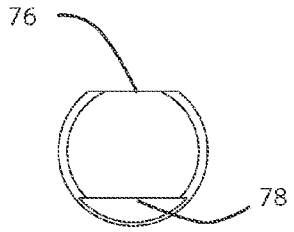
FIG. 8C is a top plan view of the lock button.
Figure 8B:
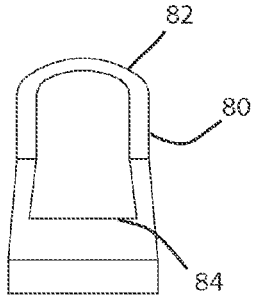
FIG. 8B is a front plan view of the lock button.
Figure 8A:
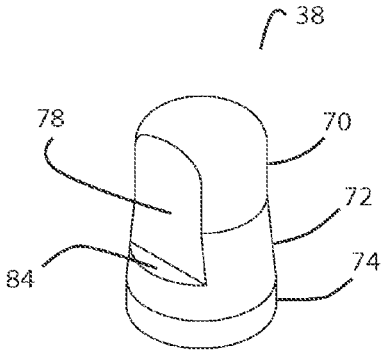
FIG. 8A front perspective view of a lock button of the knife.
Figure 8D:
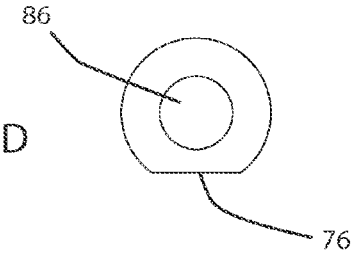
FIG. 8D is a bottom plan view of the lock button.

Referring to FIGS. 8A-8D, with further reference to FIGS. 2-7, the lock button 38 is configured to interact with other portions of the locking assembly to inhibit rotation of the blade 14 and includes a top portion 70, a middle portion 72, and a bottom or base portion 74. As best seen in FIGS. 8C-8D, the button 38 has a flat back surface 76 extending across the top, middle, and bottom portions 70, 72, 74. The top and middle portions 70, 72 also have a flat front surface 78, with the flat surface 78 extending over part, but not all, of the middle portion 72. The top portion 70 has a lower region 80 that is cylindrical except for the flat surfaces 76, 78, and a domed top surface or crown 82. The shape of the crown 82 helps the lock button 38 to slide across the floor of the lock well 52. The top portion 70 is sized and shaped to slide within the liner holes 64, 66, with the flat surface 76 interfering with the flat wall 67 to inhibit rotation of the lock button 38. The middle portion 72 is generally frusto-conically shaped, but includes a portion of the flat surface 76 and a portion of the flat surface 78. Thus, the middle portion 72 has two sections of its perimeter that are arcuate in shape with a radius that varies along a length of its axis, i.e., from top to bottom. The middle portion 72 includes a shelf 84 where the flat surface 78 ends. The middle portion 72 is sized and shaped such that an upper end of the middle portion fits within the lock notches 40, 42, and a lower end of the middle portion, adjacent the bottom portion 74 between the shelf 84 and the bottom portion 74, has a diameter exceeding those of the lock notches 40, 42. Thus, the middle portion 72 of the lock button 38 will interfere with walls of the notches 40, 42 to prevent insertion of the button 38 into, or reception of the button 38, by the notches 40, 42 up to the base portion 74. That is, the lock button 38 cannot be completely passed through either of the notches 40, 42, but is fully received when the radius of the middle portion 72 passing into the respective notch 40, 42 reaches the radius of the respective notch 40, 42 and thus seats on the wall of the slot 40, 42. The lock button 38 and flattened liner hole 66 are configured such that the front flat surface 78 will face inward, toward the walls of the notches 40, 42 and be disposed adjacent to the transition ridges 46, 48 when the button 38 is received by the notches, 42. As seen in FIG. 8D, the button 38 provides a hole 86 sized and shaped to receive the biasing spring 36. The hole 86 extends through the bottom portion 74 into the middle portion 72 of the lock button 38.

Assembly of the locking assembly 24 portion of the knife 10 is straightforward. The spring 36 is inserted into the hole 86 in the lock button 38. The spring 36 and bottom of the lock button 38 are received by the relief recess 58 in the right bolster 20*b*. The button 38 is aligned with and inserted through the liner hole 66 in the right liner 34*b* with the back flat surface 76 of the button 38 disposed adjacent to the flat wall 67 of the hole 66. The button is further partially inserted into one of the notches 40, 42 if the knife 10 is fully open or closed, respectively. If the knife 10 is partially open/closed, then the button 38 is disposed adjacent to the arcuate portion 50 of the outer surface 44 of the tang 18, with the shelf 84 biased against right-side surface of the tang 18. In either case, the button 38 extends beyond the tang 18 toward the left bolster 20*a*. The button 38 is further received through the liner hole 64 in the left liner 34*a*. The crown 82 of the button 38 is received by the lock well 52 of the left bolster 20*a*.

Referring to FIGS. 9-13, with further reference to FIGS. 1-8, the knife 10 is operated as follows. As shown in FIGS. 1A and 9A-9C, the knife 10 is in the open, locked position. The lock button 38 is fully received by the notch 40 in the tang 18, with the frusto-conical middle portion 72 of the button 38 seated in the notch 40 and pushing against the wall of the notch 40. This, in conjunction with the interaction and contact between a wall of a pivot hole 33 provided by the blade 14 and the pivot pin 32 hold the blade 14 in place. The shape of the ridge 46 helps retain the lock button 38 within the notch 40 to inhibit undesired withdrawal of the button 38 from the notch 40 and undesired rotation of the blade 14 away from the open position.

Referring to FIGS. 10A-10C, 11, and 13, with further reference to FIGS. 1-8, the blade is unlocked and rotated toward the closed position. The left bolster 20*a* is rotated counterclockwise (when viewed from the left) upward by pushing upward on the bolster, e.g., on the thumb ridges 23, to the position shown in FIG. 13. This causes the crown 82 to slide within the lock well 52 along the floor of the deep end 56 and up the ramp 55. The ramp 55 pushes the button 38 against the bias of the spring 36 toward the right bolster 20*b*, transverse to a length of the knife 10 and parallel to a pivot axis of the pivot pin 32. The ramp 55 pushes the button 38 out of the notch 40 such that the bottom portion 74 and the middle portion 72 from the junction between the bottom portion 74 and the middle portion 72 to beyond the shelf 84 are retracted from the notch 40. As shown best in FIG. 10C, the blade 14 is free to rotate without the tang 18 interfering with the button 38, i.e., the middle portion 72. The front surface 78 of the button 38 is displaced outwardly of the arcuate portion 50 of the outer surface 44 of the tang 18 (as it was while in the locked position). With the shelf 84 removed from the notch 40, the blade 14 is then rotated from the open position toward the closed position, with the front surface 78 of the button 38 sliding along the outer surface 44 and the shelf 84 overlapping the tang 18. For example, a user can pull on the actuator arm (flipper) 17 to rotate the blade 14, here to initiate the rotation that is then taken over by the assist mechanism. The button 38 is slid from the position shown in FIG. 10C, close to the open-blade position, to the position shown in FIG. 11, close to the closed-blade position.

Figures 9A, 9B, 9C, 10A, 10B, 10C, 11, 12A, 12B, 12C:
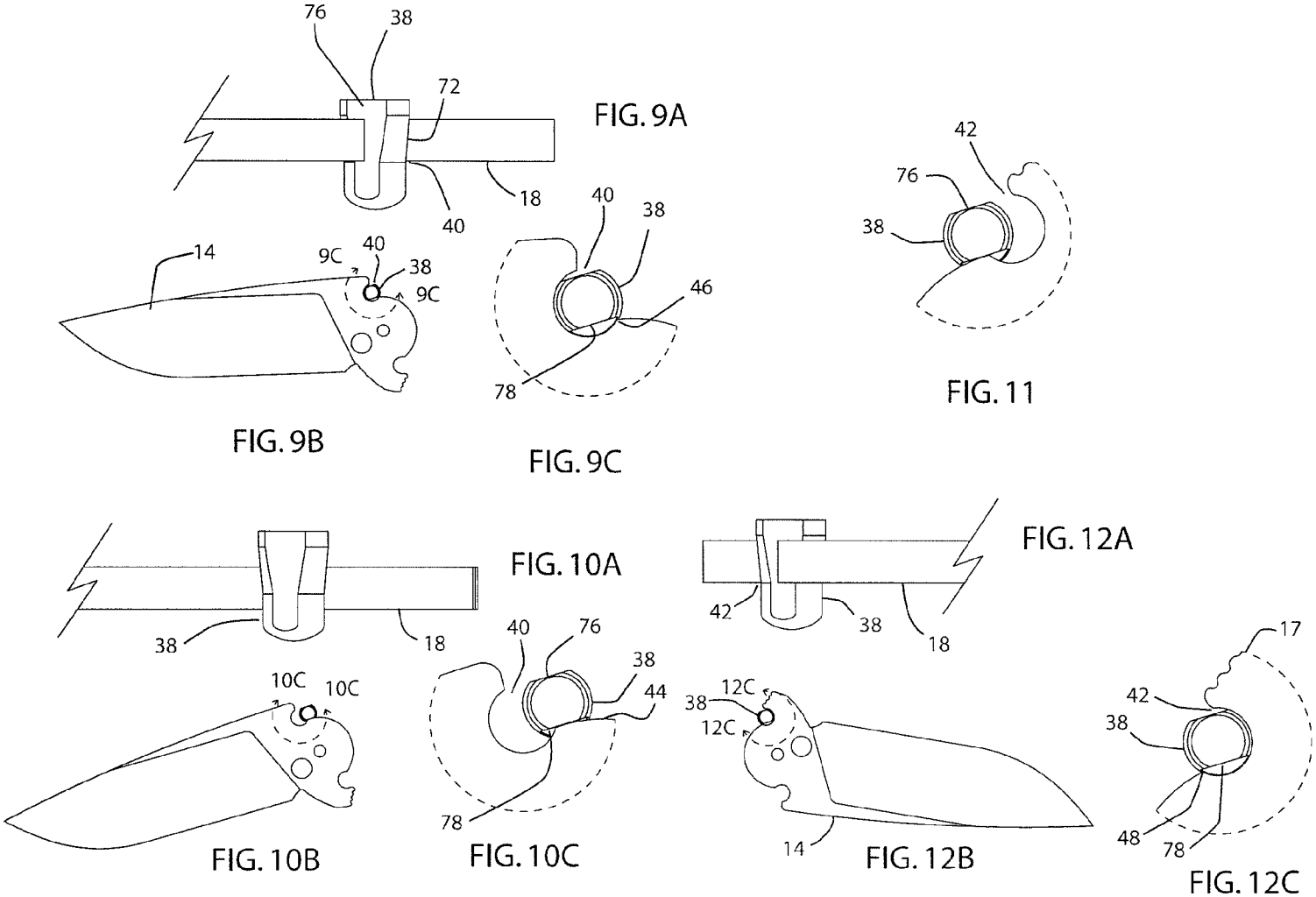
FIG. 9A is a top view of the lock button in relation to the blade notch when the blade is in the open locked position.
FIG. 9B is a left-side view of the blade and the lock button when the blade is in the open locked position.
FIG. 9C is a detailed view of the blade and the lock button when the blade is in the open locked position.
FIG. 10A is a top view of the lock button in relation to the blade notch when the blade is in an unlocked position.
FIG. 10B is a left-side view of the blade and the lock button when the blade is in an unlocked position, close to the open locked position.
FIG. 10C is a detailed view of the blade and the lock button when the blade is in the unlocked position, close to the open position.
FIG. 11 is a detailed view of the blade and the lock button when the blade is an unlocked position, close to the closed locked position.
FIG. 12A is a top view of the lock button in relation to the blade notch when the blade is in the closed locked position.
FIG. 12B is a left-side view of the blade and the lock button when the blade is in the closed locked position.
FIG. 12C is a detailed view of the blade and the lock button when the blade is in the closed locked position.
Figure 13:
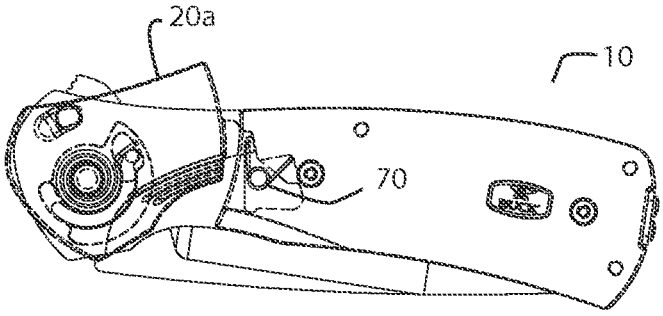
FIG. 13 is a left plan, partially cut-away view of the knife with a bolster in an unlocked position.
Figure 14:
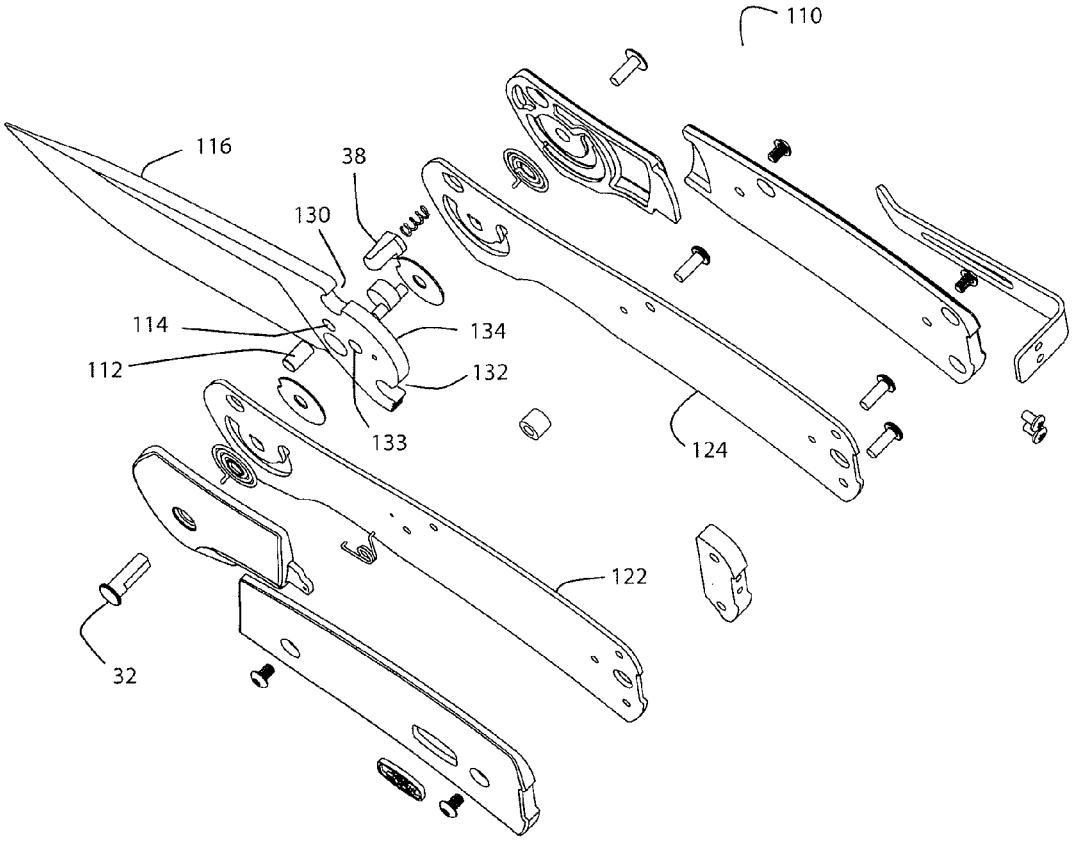
FIG. 14 is an exploded view of an alternative knife that includes a stop pin.
Figure 15:
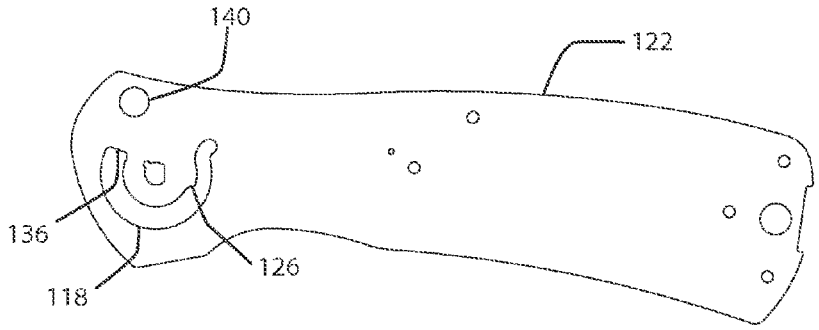
FIG. 15 is a plan view of a left-side liner of the alternative knife.
Figure 16:
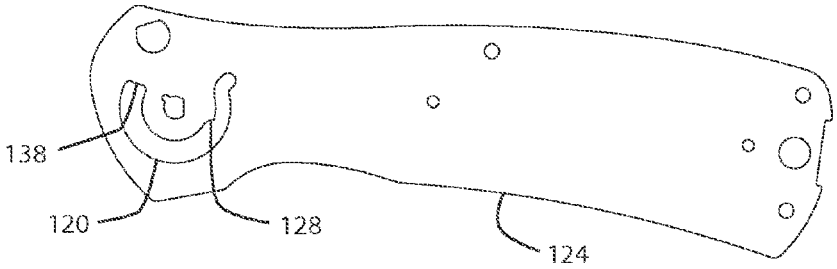
FIG. 16 is a plan view of a right-side liner of the alternative knife.

Referring to FIGS. 12A-12C, with further reference to FIGS. 1-8, the knife 10 is locked into the closed position. When the shelf 84 of the lock button 38 enters into the notch 42, no longer overlapping the tang 18, the bias of the spring 36 urges the lock button 38 further into and through the closed lock notch 42. The button 38 moves into the notch 42 until, as with the notch 40, the frusto-conical middle portion 72 of the button 38 is fully received by the notch 42 and pushes against the wall of the notch 42. This, in conjunction with the interaction and contact between the blade 14 and the pivot pin 32 hold the blade 14 in place.

The left bolster 20*a* is then returned to its closed position shown in FIGS. 1A-1B. The left bolster is released, e.g., upward force on the bolster 20*a* is removed (as it could be earlier, while the blade is being rotated between the open and closed positions). Without upward force greater than the spring force provided by the bolster spring 70, the left bolster 20*a* is rotated and returned to its closed position. The spring force provided by the spring 70 toggles the bolster 20*a* such that when the bolster 20*a* is in the open position the spring 70 helps retain the bolster 20*a* in the open, unlocked position and when the bolster 20*a* is in the closed position the spring 70 helps retain the bolster 20*a* in the closed, locked position to inhibit undesired or unintentional unlocking of the knife 10.

Other embodiments are within the scope of the disclosure and claims. For example, the button 38 need not move directly transverse to the length of the knife, and may move nearly parallel to the length of the knife 10. The button moves substantially transverse to the knife's length as long as there is enough transverse movement, regardless of the amount of parallel-to-the-length movement, to interfere with the implement 14 sufficiently to impede rotation of the implement 14. For example, the bolster lock mechanism described above may be employed in a wide variety of knives (or even other applications). For example, a knife assembly may include a bolster lock mechanism similar to that described above, but not include an open-assist feature like that of the assembly described above. Thus, the blade is not spring-biased toward the open position in this assembly and corresponding springs are not included and corresponding liner slots are not provided. Further, the described bolster-lock mechanism and variations thereof may be employed in knives, e.g., with other blade configurations (e.g., double-ended configurations with a blade on one end and another feature, e.g., a clip, on the other end), handle configurations, and/or features (e.g., carabiner clips, bottle openers, etc.).

Still further embodiments are possible. For example, referring to FIGS. 14-20, a knife 110, similar to the knife 10 shown in FIGS. 1-13, provides a bolster-locking mechanism, an open-assist mechanism, and a stop pin 112 to provide triangulation, i.e., three points of contact with a blade 116 to inhibit movement of the blade 14 when in either an open position or a locked position.

The stop pin 112 is provided and fixed within, e.g., press fit into, a hole 114 provided by the blade 116. Slots 118, 120 provided by left and right liners 122, 124 for guiding pins of an open-assist cam provide closed-position stop lips 126, 128, respectively. The slots 118, 120 are wider than the liner slots in the knife 10 in order to accommodate the stop pin 112. The stop pin 112 and the slots 118, 120 are disposed and configured to allow the stop pin 112 to slide within the slots 118, 120 when the blade 116 is rotated. The lips 126, 128 are shaped to inhibit or prevent further rotation of the stop pin in a counterclockwise direction relative to the liners 122, 124 as viewed in FIGS. 15-16.

The stop pin 112 is disposed and shaped, and the lips 126, 128 are disposed and shaped, in conjunction with locations and configurations of a closed-position lock notch 132 provided by the tang 134 of the blade 116, and a location and configuration of the lock button 38 such that as the lock button 38 moves into the closed notch 132, the stop pin 112 is pushed against the lips 126, 128. The interference of the stop pin 112 with the lips 126, 128 stops the rotation of the blade 116 before the interference of the lock button 38 with a top edge of the notch 132 stops further insertion of the lock button 38 into the notch 132.

Similarly, the stop pin 112 is disposed and shaped, and ends 136, 138 of the slots 118, 120 are disposed and shaped, in conjunction with locations and configurations of an open-position lock notch 130 provided by the tang 134 of the blade 116, and the location and configuration of the lock button 38 such that as the lock button 38 moves into the open notch 130, the stop pin 112 is pushed against the slot ends 136, 138. The interference of the stop pin 112 with the slot ends 136, 138 stops the rotation of the blade 116 before the interference of the lock button 38 with a top edge of the notch 130 stops further insertion of the lock button 38 into the notch 130.

A liner hole 140 provided by the liner 122 is disposed such that an axis of the frusto-conical middle portion 72 of the lock button 38 is slightly misaligned relative to the axes of the notches 130, 132 with the blade 116 rotated to the open and closed positions, respectively. The misalignment causes the frusto-conical middle portion 72 to push against the wall of the respective notch 130, 132 to cause the blade 116 to further rotate open or closed (clockwise or counterclockwise when viewed from the left side), respectively. Thus, the lock button 38 urges further rotation of the blade 116, and the further rotation is stopped by interaction of (interference by) the stop pin 112 with either the lips 126, 128 or the slot ends 136, 138. The three points of contact for the locked positions of the blade 116 are formed by (1) the lock button 38 interfering with an edge of one of the notches 130, 132, (2) the stop pin 112 interfering with the lips 126, 128 or the slot ends 136, 138 (with these points of contact effectively constituting one point of contact), and (3) the pivot pin 32 interfering with a wall of a pivot hole 133 provided by the blade 116.

Still further embodiments are within the scope of the disclosure. For example, other shapes of lock buttons are possible. A conically-shaped lock button could be used, as a portion of the button would be frusto-conically shaped. Other shapes could be used, preferably with a portion of the button having a frusto-conically shaped portion, or at least a portion with at least one section of its perimeter being arcuate with a varying radius along a length of the button.

What is claimed is:

1. A folding tool comprising:

a handle including first and second housing members configured to be grasped by a user's hand, the first and second housing members extending along a length of the tool and providing a cavity between the first and second housing members;

an implement disposed between the first and second housing members and pivotally connected to the first housing member and the second housing member about a pivot pin between an open position and a closed position, the implement including a first operative portion configured to extend external to the handle in a direction along the length of the tool when in the open position, the implement configured to be at least partially received by the cavity when the implement is in the closed position, the implement further including a tang that provides a pivot hole configured to receive the pivot pin, the tang further providing a locking receptacle;

a locking member movably connected to one of the housing members to move substantially transverse to a length of the implement and substantially parallel to an axis of the pivot pin, the locking member being configured to be received by the locking receptacle provided by the implement and to inhibit rotation of the implement when received by the locking receptacle; and a bolster disposed external to the first housing member and the cavity in a direction parallel to an axis of rotation of the implement about the pivot pin, the bolster pivotally connected to the first housing member to be rotated between a locked position and an unlocked position, the bolster being disposed and configured to engage the locking member such that with the locking member received by the locking receptacle, rotating the bolster from the locked position to the unlocked position causes the bolster and the locking member to interact to retract the locking member from the locking receptacle to facilitate rotation of the implement.

2. The folding tool of claim 1 wherein the locking receptacle has a circularly-shaped perimeter and the locking member has an arcuate perimeter of varying radius along a length of its axis.

3. The folding tool of claim 1 wherein the locking receptacle is an open locking receptacle disposed to lock the implement in the open position when the open locking receptacle receives the locking member, and wherein the tang provides a closed locking receptacle disposed to lock the implement in the closed position when the closed locking receptacle receives the locking member.

4. The folding tool of claim 3 wherein the tang provides an arcuate surface with a constant radius from a pivot axis of the implement and extending between the open locking receptacle and the closed locking receptacle, and wherein the open and closed locking receptacles are notches extending at least partially radially away from the arcuate surface.

5. The folding tool of claim 4 wherein the arcuate surface is an outer surface of the tang and the open and closed locking receptacles extend toward the pivot axis from the arcuate surface.

6. The folding tool of claim 1 further comprising:

a stop post extending from the tang; and an interfering mechanism for inhibiting rotation of the implement while the locking member is being received by the locking receptacle.

7. The folding tool of claim 6 wherein the interfering mechanism comprises a surface of a liner, fixedly attached to the first housing member, extending at least partially transverse to an arc traveled by the stop post when the implement is rotated.

8. A folding knife comprising:

a handle comprising first and second handle portions fixedly connected to each other and providing a blade storage area between the handle portions;

a blade pivotally connected to the handle to allow rotation of the blade from an open position extending away from the handle portions to a closed position where the blade is received by the blade storage area;

a bolster disposed mostly external to the handle and the blade storage area in a direction parallel to an axis of rotation of the blade, the bolster pivotally connected to the handle such that the bolster can rotate between a bolster lock position and a bolster unlock position; and a locking mechanism coupled with the handle, the blade, and the bolster, for locking the blade to inhibit rotation of the blade relative to the handle, the locking mechanism and the bolster being arranged such that rotation of the bolster from the bolster lock position to the bolster unlock position causes movement of the locking mechanism in a first direction substantially transverse to the length of the handle and substantially parallel to the axis of rotation of the blade to disengage the locking mechanism from the blade and rotation of the bolster from the bolster unlock position to the bolster lock position allows movement of the locking mechanism in a second opposite direction substantially transverse to the length of the handle to engage the locking mechanism with the blade.

9. The knife of claim 8 wherein the locking mechanism engages portions of the blade and is configured to lock the blade in the open position and in the closed position.

10. The knife of claim 9 wherein the blade pivots about a pivot axis and has a tang portion with an outer arcuate surface section between an open locking notch and a closed locking notch, the arcuate outer surface being concentric with the pivot axis, wherein a sharp closed lip is provided at a junction between the arcuate tang portion and the closed locking notch and a sharp open lip is provided at a junction between the arcuate tang portion and the open locking notch.

11. The knife of claim 10 wherein the locking mechanism comprises a locking button, and wherein a portion of the bolster is disposed and configured to engage the locking button such that if the locking button is fully received by one of the locking notches, then when the bolster is rotated the bolster and the locking button will interact to move the locking button away from being fully received by the one of the locking notches, the locking button allowing rotation of the blade between the open and closed positions when all portions of the locking button overlapping with a thickness of the blade along an axis parallel to the pivot axis are disposed further from the pivot axis than the closed lip or the open lip, respectively.

12. The knife of claim 11 wherein the locking notches have arcuate perimeters, and the locking button has a domed top surface and a frusto-conical portion having a largest radius exceeding radii of the arcuate perimeters of the locking notches.

13. The knife of claim 8 further comprising a stop pin, at least one opening-rotation inhibiting surface, and at least one closing-rotation inhibiting surface, wherein the locking mechanism is configured to interact with the blade while being moved to engage the blade to lock the blade in the open position to cause open rotation of the blade further toward the open position and the stop pin and the at least one opening-rotation inhibiting surface are disposed and configured to stop the open rotation of the blade caused by the locking mechanism, and wherein the locking mechanism is configured to interact with the blade while being moved to engage the blade to lock the blade in the closed position to cause closing rotation of the blade further toward the closed position and the stop pin and the at least one closing-rotation inhibiting surface are disposed and configured to stop the closing rotation of the blade caused by the locking mechanism.

* * * * *